US006435559B2

(12) United States Patent
Duke

(10) Patent No.: US 6,435,559 B2
(45) **Date of Patent: *Aug. 20, 2002**

(54) ADJUSTABLE BOOK JACKET AND COVER

(75) Inventor: Bernard Duke, Wall, NJ (US)

(73) Assignee: Animalia, Inc., Allenhurst, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/157,227

(22) Filed: Sep. 18, 1998

(51) Int. Cl.[7] ..... B42D 3/00

(52) U.S. Cl. ..... 281/29; 40/124.01; 281/15.1; 281/17; 312/128; 312/233; 434/317

(58) Field of Search ..... 281/19.1, 19.2, 281/17, 29, 36, 37, 15.1, 34, 16, 35; 312/107, 128, 233; 206/450; D19/26; 211/55; 434/317; 40/124.01, 359, 360

(56) References Cited

U.S. PATENT DOCUMENTS 609,071 A * 8/1898 Akins ..... 281/19.1

(List continued on next page.)

FOREIGN PATENT DOCUMENTS

| | | | | |
|---|---|---|---|---|
| FR | 747113 | * | 3/1932 | ..... 281/29 |
| FR | 894536 | * | 5/1943 | ..... 281/29 |
| GB | 6795/1887 | * | of 1887 | ..... 281/29 |
| GB | 919574 | * | 3/1963 | ..... 281/29 |
| GB | 2075915 | * | 11/1981 | ..... 281/29 |
| IT | 724389 | * | 11/1966 | ..... 281/29 |
| JP | 11-208147 | * | 8/1999 | |

OTHER PUBLICATIONS

The Story of Kappa Alpha Psi, Crump, Kappa Alpha Psi Fraternity, 1991.*

*Primary Examiner*—A. L. Wellington
*Assistant Examiner*—Monica Carter
(74) *Attorney, Agent, or Firm*—Rosenberg, Klein & Lee

(57) ABSTRACT

An adjustable book jacket and book cover combination for a book comprising a book jacket for covering said book cover wherein the book jacket contains printed indicia of the subject matter of said book, and the jacket indicia, by reason of graphics, color or text is susceptible to easy perception and identification when said book containing said book jacket is arranged in partial overlapping sequence from east to west. The book cover similarly contains printed indicia of the subject matter of the book and said cover indicia by reason of graphics, color or text being susceptible is also easy perceived and identified when said book containing said book cover is arranged in partial overlapping sequence from north to south.

8 Claims, 2 Drawing Sheets

U.S. PATENT DOCUMENTS

| | | | | | |
|---|---|---|---|---|---|
| 752,537 | A | * | 2/1904 | Eneas | 281/19 |
| 861,020 | A | * | 7/1907 | Coulter | 281/36 |
| 1,965,679 | A | * | 7/1934 | Welliver et al. | |
| 2,742,070 | A | * | 4/1956 | Jones | |
| 3,553,851 | A | * | 1/1971 | Paige | 206/232 |
| 3,921,811 | A | * | 11/1975 | Dameron | 108/61 |
| D282,225 | S | | 1/1986 | Sandy | D6/474 |
| 4,682,792 | A | * | 7/1987 | Simmons | 281/20 |
| D291,754 | S | | 9/1987 | Griswold | D6/553 |
| 4,715,619 | A | | 12/1987 | Sloot | 281/19 |
| D294,441 | S | | 3/1988 | Hoch | D6/461 |
| 4,795,194 | A | * | 1/1989 | Etheridge | 281/34 |
| 4,819,964 | A | * | 4/1989 | Dupuis | 281/35 |
| 4,886,299 | A | * | 12/1989 | Ducorday | 156/251 |
| D306,380 | S | | 3/1990 | Kemble | D6/478 |
| 4,962,951 | A | | 10/1990 | Mechesney | 283/114 |
| 5,038,689 | A | * | 8/1991 | Duffy | 108/108 |
| 5,087,078 | A | * | 2/1992 | Phillips | 281/31 |
| D329,552 | S | | 9/1992 | Wells et al. | D6/461 |
| 5,156,271 | A | * | 10/1992 | Toner | 156/227 |
| 5,158,325 | A | | 10/1992 | Landis et al. | 281/42 |
| D340,596 | S | | 10/1993 | Sandy | D6/449 |
| 5,328,037 | A | | 7/1994 | Fuji | 211/55 |
| 5,397,156 | A | * | 3/1995 | Schach et al. | 206/424 |
| 5,447,242 | A | | 9/1995 | Kelly et al. | 211/42 |
| 5,470,109 | A | | 11/1995 | Grande | 281/34 |
| D370,141 | S | | 5/1996 | Kelly et al. | D6/475 |
| 5,515,972 | A | * | 5/1996 | Shames | 206/232 |
| D388,266 | S | | 12/1997 | Axelrod | D6/473 |
| 5,720,564 | A | * | 2/1998 | Winzen | 281/29 |
| 5,851,031 | A | * | 12/1998 | Golson | 281/19.1 |
| 5,853,259 | A | * | 12/1998 | Murray | 281/29 |
| 5,876,143 | A | * | 3/1999 | Ong | |
| 5,893,585 | A | * | 4/1999 | Worthen | 281/29 |
| 6,257,622 | B1 | * | 7/2001 | Peker | 281/16 |
| 6,275,142 | B1 | * | 8/2001 | Paleiov et al. | 340/10.1 |

* cited by examiner

ADJUSTABLE BOOK JACKET AND COVER

FIELD OF THE INVENTION

This invention relates to an adjustable book jacket and cover providing the retailer the option of displaying the book title in either a north-south or east-west configuration in a display rack.

BACKGROUND OF THE INVENTION

A variety of prior art disclosures have come forward directed at various improvements to book jacket designs, display racks or book display stands. These disclosures have taken the form of both utility and design patents.

The design patents have principally been directed at various ornamental designs for displaying books in, e.g., a commercial retail environment, and include the following: Des. 388,266 entitled "Book Display Stand"; Des. 370,141 entitled "Tall Book Display Rack"; Des. 340,596 entitled "Book Display Rack"; Des. 329,552 entitled "Book Display Stand"; Des. 306,380 entitled "Book Display Module"; Des. 291,754 entitled "Combined Book and Magazine Display"; and Des. 282,225 entitled "Magazine Display Rack".

Utility Patents start with, e.g., U.S. Pat. No. 4,715,619 directed at a book jacket that can fit around a book independent of its thickness enabling the placement of a display at a desired location with respect to the book such as its spine or front cover. In U.S. Pat. No. 4,962,951 there is disclosed a system for correlating one or more books with other related information comprising a t least one book cover having a preprinted indicia of the subject matter of the book, and a companion storage means, such as note books, file folders or other storage means, having the same prominent indicia preprinted or preaffixed on its front or outer surface so that subject identification and the correlation of several elements is readily perceived.

U.S. Pat. No. 5,158,325 discloses an adjustable size book jacket including a first pouch section that is composed of an elastomeric material and has a first opening formed therein for receiving the front cover of a book and generally conforming to at least a portion of the periphery of the front cover.

U.S. Pat. No. 5,328,037 discloses a magazine display rack which allows for varying widths of displayed magazines and contributes to an enhanced appearance in the rack.

U.S. Pat. No. 5,447,242 discloses a tall book display rack, and in particular, book or display racks made of lightweight materials chosen from the group consisting of styrofoam, foamed urethane, corrugated paperboard, and honycombed paperboard.

U.S. Pat. No. 5,470,109 discloses an adjustable book jacket for covering 100% of the external surface of book covers in a wide range of book sizes. A LYCRA-spandex fabric is cut in a unique diamond shaped pattern which is said to eliminate waste fabric during production, and assures that the differential X and Y axis stretch characteristics of the fabric are properly located on the book jacket.

As can be seen from the above review of the prior art, most of the work in this area has focused on new ways to position books or magazines in an attractive and functional setting, and there have been efforts directed to the preparation of book jackets that more neatly and snugly cover a book without visible seams. While all of these efforts have no doubt advanced the state of the art, they have all collectively failed to recognize a unique problem in the display and presentation of books that now confronts most retail establishments.

More specifically, bookstores, libraries and the like may at times present books in an overlapping sequence going from east to west, whereas magazine-type racks overlap from north to south. When the books are spined-out, only the back of the book is readable. That being the case, when a book contains a printed cover with the title running only east-to-west (the conventional situation), it is unsuitable for presentation in a rack where the books are overlapped east to west. The title will be eclipsed as the books lay partially on top of one another.

Alternatively, should a book contain a printed cover with the title running only north to south, the book will not present well should one desire to display such books in a north to south configuration. Again, the north to south title will be eclipsed as the books lay partially on top of one another in the north to south arrangement.

The above being the case, it is an object of this invention to provide book sellers a novel system wherein the books can be optionally presented in either an overlapping sequence running east to west or north to south, or spined out, wherein the title of the book in either situation remains in full view for the prospective purchaser.

SUMMARY OF THE INVENTION

An adjustable book jacket and book cover combination for a book comprising a book jacket for covering said book cover wherein said book jacket contains printed indicia of the subject matter of said book, said jacket indicia by reason of graphics, color or text being susceptible to easy perception and identification when said book containing said book jacket is arranged in partial overlapping sequence from east to west wherein said book cover similarly contains printed indicia of the subject matter of said book, said cover indicia by reason of graphics, color or text being susceptible to easy perception and identification when said book containing said book cover is arranged in partial overlapping sequence from north to south. Alternatively, the book cover can be made to contain said indicia in north to south configuration, and said jacket can be made to contain said indicia in east to west configuration.

DESCRIPTION OF THE PREFERRED EMBODIMENTS

As noted, the present invention provides an adjustable book jacket and cover combination which allows book sellers or libraries a novel system wherein the books can be presented in either an overlapping sequence running east to west, or in overlapping sequence running north to south, wherein the title of the book remains in full view for the prospective purchaser.

Figure 1:
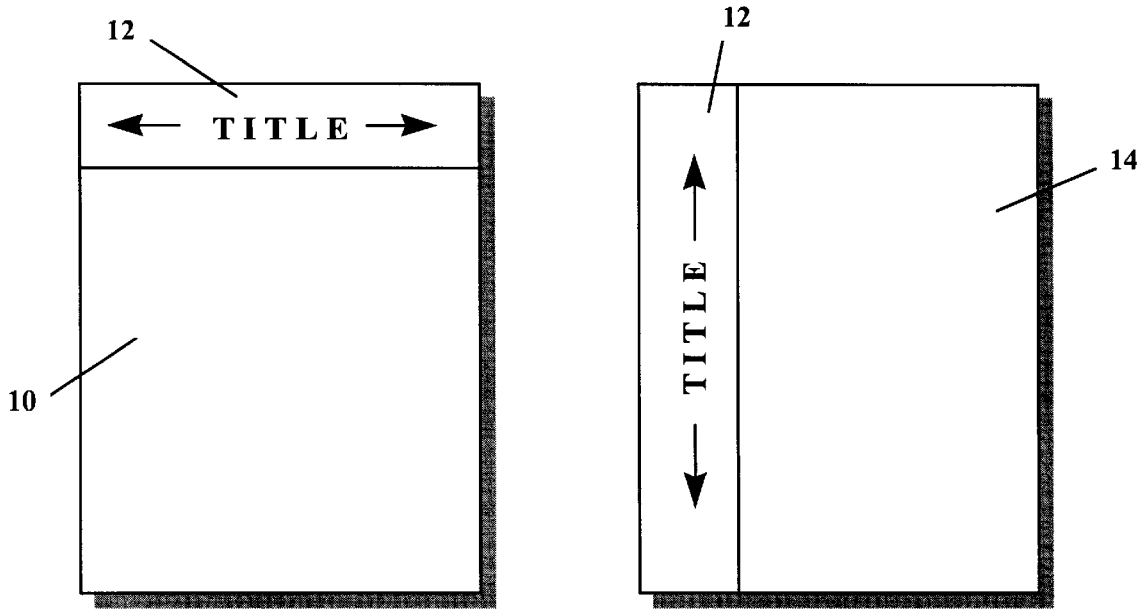
FIG. 1 is a view of the adjustable book jacket and cover combination of the present invention.
Figure 3:
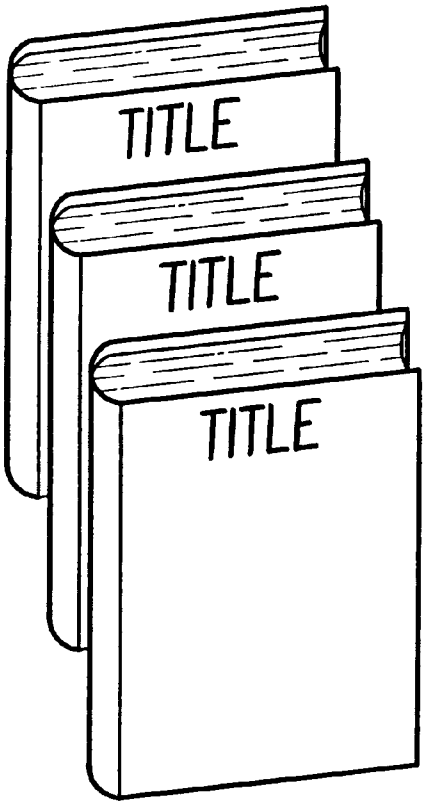
FIG. 3 is a schematic view illustrating a partial North–South overlapping sequence of books.
Figure 2:
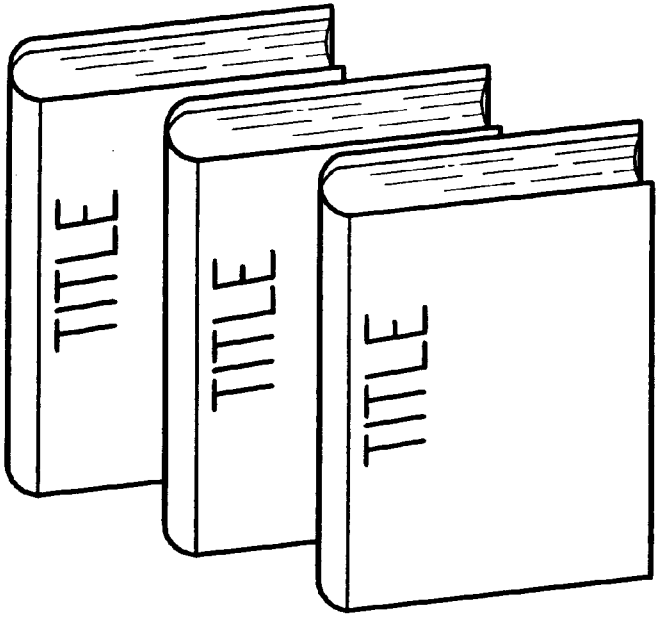
FIG. 2 is a schematic view illustrating a partial East–West overlapping sequence arrangement of books.

FIG. 1 provides a side-by-side illustration of the book cover 10 containing title 12 running in the conventional east to west configuration. The book cover 10 is part of the book.

Those skilled in the art will appreciate that the title 12 on the book cover 10 may also comprise other printed indicia of the subject matter of the book via the use of graphics or color. For example, the general area around the title 12 can be made a different color than the other sections of the cover 10 to facilitate easy perception of the title when the book is displayed.

Also shown in FIG. 1 is the book jacket 14 which exists as a loose part of the book and which can be removed without any difficulty. Typically, the cover 10 will have flaps (not shown) that surround a portion of the book edge and secure the jacket 14 to the book cover 10. As shown, the jacket 14 contains the title 12 running in a north to south configuration.

Accordingly, when a book is provided with the cover 10 and jacket 14, the seller has two presentation options available. First, should the seller or library wish to display the books in an partial overlapping sequence running north to south, while maintaining view of the title, the jacket 14 is easily removed and the title 12, running east to west, permits north to south partial overlap and title presentation.

Alternatively, should the seller or library opt to display the books in partial overlapping sequence running east to west, the jacket 14 is allowed to remain on the book cover 10. In this manner, east to west partial overlapping of the jacket 14 does not obscure the title 12 from being seen by the prospective purchaser.

Finally, although not shown in FIG. 1, it will be appreciated that both the book cover and jacket will also preferably contain the printed indicia of the subject matter of the book on the spine of the book, so that when the book is placed on the shelf, in side-by-side configuration, the spine of the book will present the book title in customary fashion.

Those skilled in the art will recognize that one can simply alter the position of the title on the cover and the jacket, as disclosed herein. That is, the cover could optionally contain the title running in an north to south configuration, with the jacket containing a title running east to west. This option would of course provide the book seller or librarian the same option in presenting the books as disclosed herein. Furthermore, as disclosed herein the combination book cover and jacket system can be applied to either hardcover or paperback books.

Finally, the utility of the invention herein is worthy of note, since, it has been fairly well established that when it comes to the sale of books, those books that are presented in a face-out fashion, with the title visible, have much more successful sales. This stands in contrast to those book displays wherein the books are shelved side-by-side with only the spine (and title) visible. That being the case, the invention herein uniquely provides the book seller the opportunity to achieve greater book sales, regardless of whether the books are displayed in stacked and partially overlapping east to west or north to south configuration.

I claim:

1. A removable book jacket and book cover display system for a plurality of books comprising:

a book jacket for each of at least a first book and a second book, said book jacket of each said first and second book having predetermined identifying indicia formed thereon to remain visible and identifiable when said first and second books are displayed one relative to the other in a partial East–West overlapping sequence defining a horizontal overlapping direction, wherein said identifying indicia extends in a vertical direction;

a book cover for each of said first and second books, said book cover of each said first and second book having said predetermined identifying indicia printed thereon to remain visible and identifiable when said book jacket is removed from said book cover and when said first and second books are alternatively arranged one relative to the other in partial North–South overlapping sequence defining said vertical direction, wherein said book cover is substantially identical in visual configuration to said book jacket with the exception of said identifying indicia extending in said horizontal direction to be transversely oriented relative to said identifying indicia formed on said book jacket, thereby allowing for the unobstructed display of said identifying indicia of each of said first and second books as formed on a selected one of said book jacket and cover thereof adaptive to the relative orientation and placement of said first and second books.

2. The removable book jacket and book cover display system as recited in claim 1, wherein said book jacket and book cover contain said printed indicia of the subject matter of said book on that portion of said book jacket or book cover that forms the spine of the book.

3. The removable book jacket and cover display system as recited claim 1, wherein said book is either a hard cover or paperback book.

4. A removable book jacket and book cover display system for a plurality of books comprising:

a book jacket for each of at least a first book and a second book, said book jacket of each said first and second book having predetermined identifying indicia formed thereon to remain visible and identifiable when said first and second books are arranged one relative to the other in a partial North–South overlapping sequence defining a vertical overlapping direction, wherein said identifying indicia extends in a horizontal direction;

a book cover for each of said first and second books, said book cover of each said first and second book having said predetermined identifying indicia printed thereon to remain visible and identifiable when said book jacket is removed from said book cover and when said first and second books are alternatively arranged one relative to the other in a partial East–West overlapping sequence defining said horizontal direction, wherein said book cover is substantially identical in visual configuration to said book jacket with the exception of said identifying indicia extending in said vertical direction to be transversely oriented relative to said identifying indicia formed on said book jacket, thereby allowing for the unobstructed display of said identifying indicia of each of said first and second books as formed on a selected one of said book jacket and cover thereof adaptive to the relative orientation and placement of said first and second books.

5. The removable book jacket and cover display system as recited in claim 4, wherein said book jacket and book cover contain said printed indicia of the subject matter of said book on that portion of said book jacket or book cover that forms the spine of the book.

6. The removable book jacket and cover display system as recited in claim 4, wherein said book is either a hard cover or paperback book.

7. A coordinated book covering set for each of a plurality of books comprising:

a book cover for each of at least a first book and a second book, said book cover of each said first and second book having front and rear panels joined by a spine extending therebetween, said front panel defining a first peripheral portion, said book cover having formed adjacent said first peripheral portion predetermined identifying indicia disposed at a first orientation; and, a book jacket for each of said first and second books, said book jacket of each said first and second book being removably coupled to substantially envelop said book cover, said book jacket having a front section detachably overlaying said book cover front panel, said front section defining a second peripheral portion transversely directed relative to said first peripheral portion, said front section having said predetermined identifying indicia formed adjacent said second peripheral portion to be disposed at a second orientation transversely related to said first orientation;

said book jacket being substantially identical in visual configuration to said book cover with the exception of said transverse orientation of said predetermined identifying indicia relative to said first orientation;

said book jacket of each said first and second book being selectively removed from or coupled to said book cover thereof for adaptively maintaining said predetermined identifying indicia corresponding thereto substantially unmasked by the other of said first and second books arranged therewith in a partially overlapping adjacent manner.

8. A method of adaptively displaying a plurality of books on a display structure comprising the steps of:

(a) providing at least a first book and a second book, each having front and rear cover panels joined by a spine extending therebetween, said front cover panel defining a first peripheral portion;

(b) providing at a first orientation adjacent said first peripheral portion of each said first and second book predetermined identifying indicia corresponding thereto;

(c) selecting a display arrangement scheme for said first and second books from at least a first and a second arrangement scheme, said first and second books in said first arrangement scheme being horizontally offset one relative to the other, said first and second books in said second arrangement scheme being vertically offset one relative to the other, adjacent ones of said first and second books in each said arrangement scheme being disposed in partially overlapped manner;

(d) providing for each said first and second book a jacket for removable coupling to substantially envelop at least said front cover panel thereof, said jacket having a front section detachably overlaying said front cover panel, said front section defining a second peripheral portion transversely directed relative to said first peripheral portion;

(e) providing adjacent said second peripheral portion of said jacket of each said first and second book said predetermined identifying indicia corresponding thereto, said identifying indicia provided on said jacket being disposed at a second orientation transversely related to said first orientation, said jacket and said front cover panel being substantially identical in visual configuration with the exception of the relative orientations of said first and second orientations thereof; and, (f) adaptively removing or coupling said jacket of each said book responsive to said display arrangement scheme selection to maintain said predetermined identifying indicia of each said first and second book substantially unmasked by the other of said first and second books arranged therewith in accordance with said display arrangement scheme selected.

* * * * *